324-77
8/4/81
SR
XR 4,282,406

United States Patent [19]
Yato et al.
[11] 4,282,406
[45] Aug. 4, 1981

[54] ADAPTIVE PITCH DETECTION SYSTEM FOR VOICE SIGNAL

[75] Inventors: Fumihiro Yato, Komae; Seishi Kitayama, Tokyo; Junso Tamura, Tokyo; Hikoichi Ishigami, Tokyo; Akira Kurematsu, Yokohama, all of Japan

[73] Assignee: Kokusai Denshin Denwa Kabushiki Kaisha, Tokyo, Japan

[21] Appl. No.: 122,256

[22] Filed: Feb. 19, 1980

[30] Foreign Application Priority Data

Feb. 28, 1979 [JP] Japan ..... 54-22954

[51] Int. Cl.[3] ..... G10L 1/00
[52] U.S. Cl. ..... 179/1 SC; 324/77 G
[58] Field of Search ..... 179/1 SC, 1 SA, 1 SB, 179/1 SD, 1 P; 333/165, 166, 167; 364/724, 725; 324/77 G

[56] References Cited

U.S. PATENT DOCUMENTS

| | | | |
|---|---|---|---|
| 3,529,140 | 9/1970 | Doering | 324/77 G |
| 3,740,476 | 6/1973 | Atal | 179/1 SC |
| 3,808,370 | 4/1974 | Jackson et al. | 179/1 SC |

*Primary Examiner*—Mark E. Nusbaum
*Assistant Examiner*—E. S. Kemeny
*Attorney, Agent, or Firm*—Robert E. Burns; Emmanuel J. Lobato; Bruce L. Adams

[57] ABSTRACT

A system for detecting the pitch of a voice signal, in which a plurality of pitch searching periods are determined so that pitch components of multiple relationship are not included in each of the pitch searching periods, and in which after detecting a pitch searching period including the pitch from the pitch searching periods, the pitch searching periods are adaptively shifted in a manner to follow the change direction of the pitch predicted from the result of detection of the detected pitch.

4 Claims, 6 Drawing Figures

ADAPTIVE PITCH DETECTION SYSTEM FOR VOICE SIGNAL

BACKGROUND OF THE INVENTION

This invention relates to a system for detecting the pitch of a voice signal, and more particularly to improvement in a system for detecting the pitch of a voice signal by real time processing.

The pitch detecting system of the present invention can be utilized for analysis and synthesization of a voice. The pitch of a voice herein mentioned is the fundamental frequency of a voiced sound, which is usually in the range of (70 to 400) Hz, and the spectrum of the voice has the properties of increasing in level at the frequency of the pitch and frequencies of its integer multiples. In a system, such as vocoder, for transmitting voice signals in coded form with high efficiency, it is necessary to accurately detect and transmit the pitch which is one of basic parameters of the voice signal; and various pitch detecting system have heretofore been proposed.

Any of the conventional systems, nevertheless, has some shortcomings such as: (1) at a portion of a nasal sound or a nasalized vowel where the pitch frequency and a first Formant are close to each other, (2) at a portion where its waveform level is not maintained steady, and (3) in a glide from a voiced sound to the next one, a component of a cycle twice or half a correct pitch cycle may often be erroneously detected as the pitch cycle, resulting in inaccuracy in the detecting of pitch.

SUMMARY OF THE INVENTION

An object of this invention is to overcome the abovesaid defects of the prior art and to provide an adaptive pitch detecting system which is capable of accurately detecting the pitch from a voice signal by real time processing.

To achieve the above object, in the present invention taking notice of the fact that in the case of detecting the pitch from a voice signal at intervals of about 20 ms, the pitch detected at closely spaced sample points of time does not greatly differ in the parts of a vowel and a nasal sound or a nasalized sound and in the part of a glide from a voice sound to a voiced sound, that is, the pitch detected at each sample point has high correlation to the pitch at the immediately preceding sample point, a plurality of different pitch searching periods are prepared in each of which cycle components of multiple relationship are not included, and when searching the pitch, the pitch searching periods are each adaptively shifted on the basis of a pitch immediately detected. In other words, in a case where the pitch is correctly detected at an immediately preceding sample point of time, a correct pitch at the next sample point of time can be obtained by searching only at the vicinity of the pitch detected at the immediately preceding sample point of time, preventing detection of an erroneous pitch twice or half the correct pitch.

BRIEF DESCRIPTION OF THE DRAWINGS

The invention will be clearly understood from the following detailed description taken in conjunction with the accompanying drawings, in which.

DETAILED DESCRIPTION OF THE INVENTION

The pitch detecting algorithm adopted in the present invention employs a known auto-correlation method, and an auto-correlation coefficient $\phi_i$ is obtained by the following equation and the pitch is obtained as a delay time $\tau$ which provides a maximum value $\phi_{max}$ of the auto-correlation coefficient $\phi_i$.

$$\phi_i = \left( \sum_{t=T}^{T+\Delta T-i\Delta t} S_t \cdot S_{t+i\Delta t} \right) / \left( \sum_{t=T}^{T+\Delta T} S_t \cdot S_t \right) \quad (1)$$

where $S_t$ is a time series sampled by an input voice signal for each $\Delta t$ seconds.

A description will be given of a method of setting a plurality of pitch searching periods to be adaptively transited and a method of such transition, which constitute the principal part of the present invention, in connection with the case of providing nine kinds of pitch searching periods of modes 0 to 8.

Figure 1:
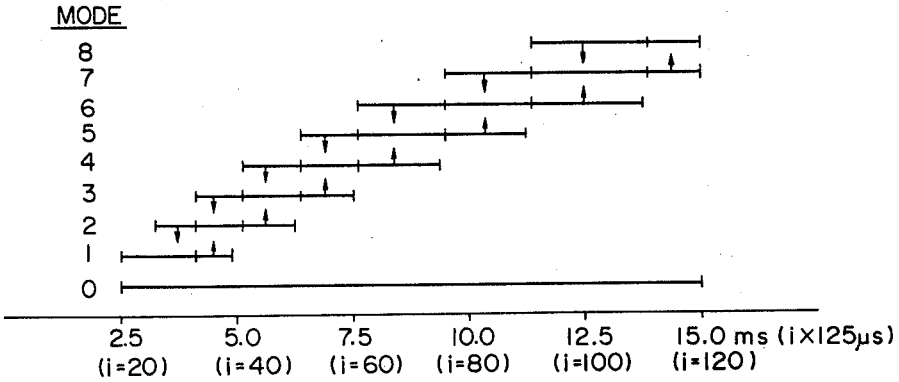
FIG. 1 is a diagram explanatory of occupied areas of modes 0 to 8 in this invention.

FIG. 1 shows occupied areas of the respective pitch searching periods, the abscissa representing time (ms).

Mode 0 is used at the start of a voice signal or after a long pause, or in a case where the pitch is not correctly detected at the immediately preceding pitch sample point of time; this is to search for the pitch over the entire time length in which the pitch is supposed to exist as described previously it is said that the pitch frequency usually exists at 70 to 400 Hz and its period is 14(2/7) to 2.5 ms. In the illustrated example, it is selected to range from 2.5 to 15 ms (i=20 to i=120) so as to satisfy the abovesaid condition.

The pitch searching periods of modes 1 to 8 are so selected as not to include therein pitch components of multiple relationships for detecting an accurate pitch. It will easily be understood that mode 1 is provided on the basis of a minimum one of pitches predicted.

Adjacent ones of modes 1 to 8 have overlapping portions as indicated by upward and downward arrows for transitions among the modes. The portions indicated by the upward arrows, the portions indicated by the downward arrows and the portions without arrows will hereinafter be referred to as higher- and lower-order transition regions and stable regions, respectively. The higher-order transition region is selected to be substantially equal to the stable region in the higher-order modes, while the lower transition region is selected to be substantially equal to the stable region in the lower-order modes.

Figure 2:
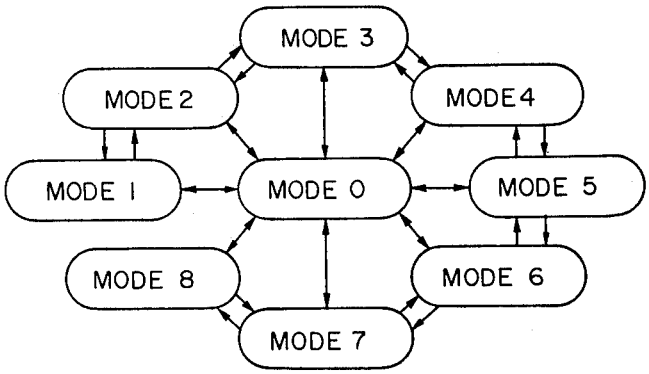
FIG. 2 is a diagram of mode transition in this invention.

Turning next to FIG. 2 diagramatically showing the mode transition, a description will be made of a method for mode transition among modes 0 to 8.

Upon detection of a voice signal, the pitch is detected in mode 0, and if this pitch is decided to be a correct one according to the condition explained in connection with an embodiment described later on, the operation is shifted to the mode where the correct pitch is included in the stable mode, and at the next pitch sample point of time, the pitch is detected in that mode. As a result of this, if the pitch still stays in the stable region, no mode transition is effected and detection of the pitch is continued in that mode. The operation is transited to the higher- or lower-order mode in dependence on whether the pitch is included in the higher- or lower-order transition region. If it is not decided that the pitch has not been detected, the operation is shifted to mode 0 which is the initial mode.

Figure 3:
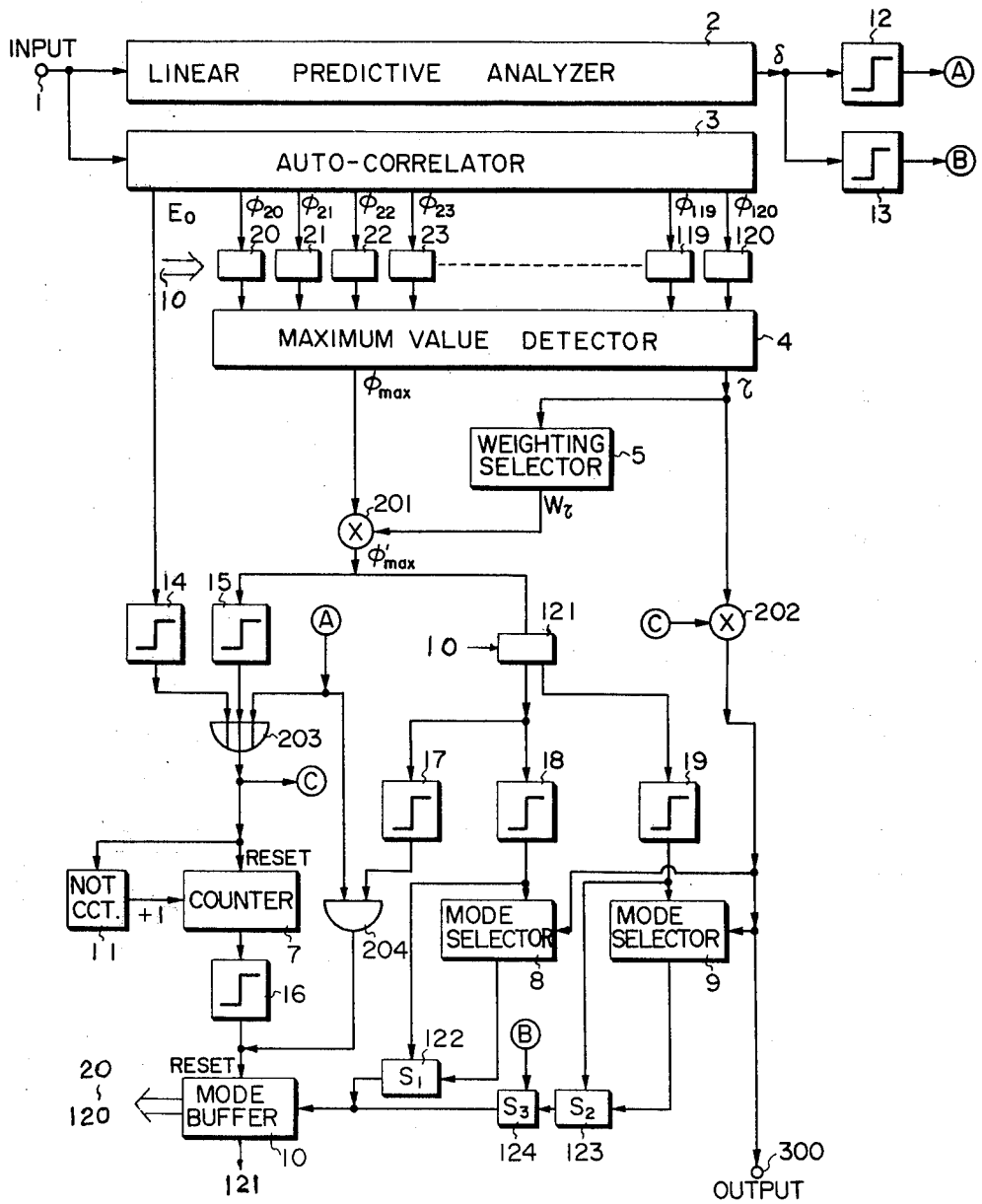
FIG. 3 is a block diagram showing an embodiment of this invention.

Next, a description will be given of an embodiment of the present invention shown in FIG. 3.

Figure 5A:
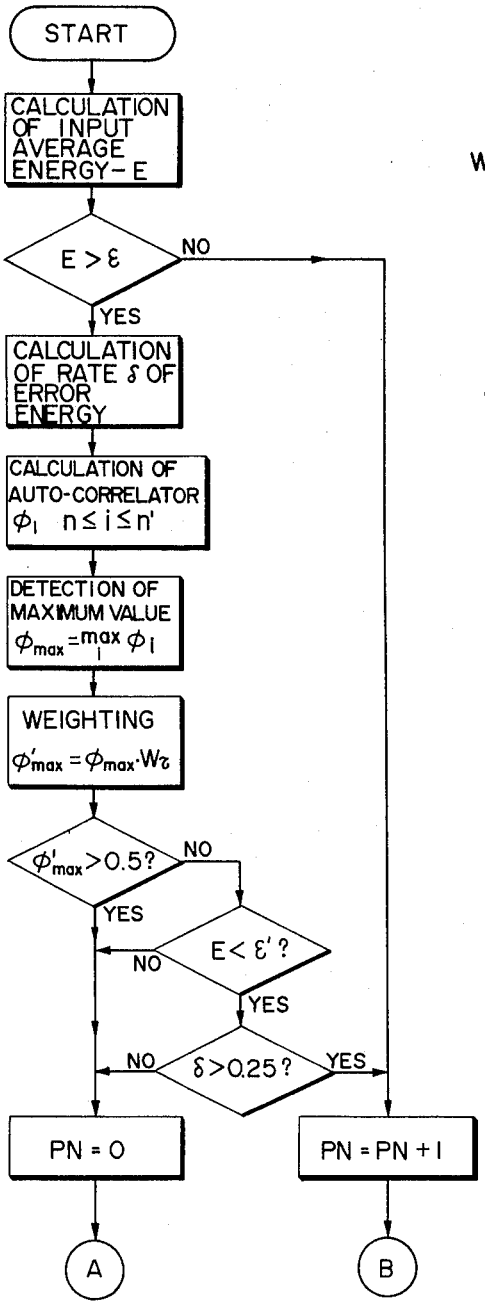
FIGS. 5A and 5B are flowcharts showing the operation of the embodiment of this invention.
Figure 5B:
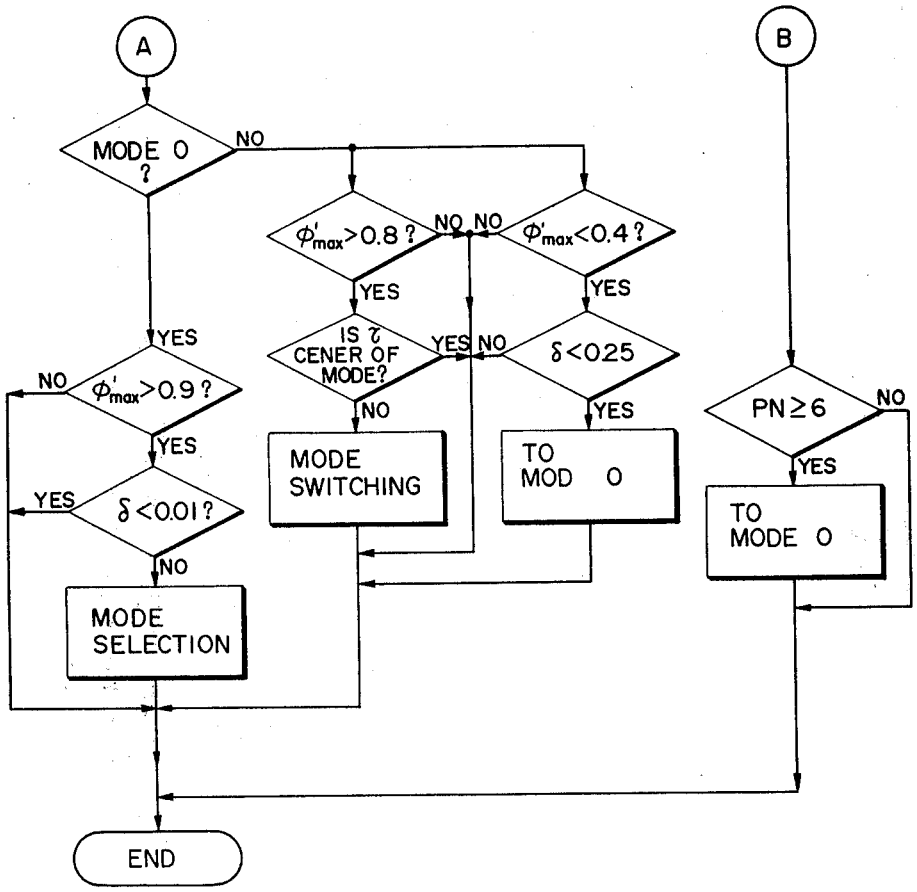

In the present embodiment, the pitch is detected at intervals of 20 ms. The flowchart of the operation of the present embodiment is as shown in FIGS. 5A and 5B.

Reference numeral 1 indicates an input terminal, to which a voice signal is applied as a time series $S_t$ sampled at 8 kHz ($\Delta t = 125\ \mu s$) after being passed through a 500 Hz low-pass filter. This input signal is branched into two, one of which is applied to a linear predictive analyzer 2 and the other of which is applied to an auto-correlator 3.

The linear predictive analyzer 2 is provided for calculating the rate $\delta$ of the residual energy to the input energy of the input signal. It is known that the rate $\delta$ of the residual energy to the input energy assumes a very small value in a case where the waveform is close to a sinusoidal one, such as a nasal sound or nasalized vowel and that this rate takes a medium value in a case of the waveform of other voiced sound and a large value in a case of an unvoiced sound. Accordingly, there are provided after the linear predictive analyzer 2 a threshold circuit 12, which has a threshold value $V_{12}$ and outputs a logic level "1" when the aforementioned rate $\delta$ is less than the threshold value $V_{12}$, and a threshold circuit 13 which has a threshold value $V_{13}$ and outputs a logic level "1" when the rate $\delta$ is less than the threshold value $V_{13}$. If the threshold values are suitably set so that $V_{12} > V_{13}$, then an output appears at a point A in FIG. 3 when a voiced wave is inputted and an output appears at a point B only when a nasal sound wave or a nasalized vowel wave is inputted. In the present embodiment, $V_{12} = 0.25$ and $V_{13} = 0.01$.

Reference numeral 3 designates an auto-correlator, which obtains the auto-correlation coefficient $\phi_i$ by the aforesaid equation (1) and calculates and outputs an energy Eo by the following equation (2) at the moment of an analysis of the input waveform.

$$Eo = \sum_{t=1}^{T+\Delta T} S_t \cdot S_t \qquad (2)$$

This energy Eo has a large value in a case of a voiced wave but a small value in a case of an unvoiced sound wave having a characteristic close to a noise. Accordingly, when the energy Eo exceeds a threshold value $V_{14}$ in a threshold circuit 14, it can be decided that a voiced sound wave is being produced.

Reference numeral 4 identifies a maximum value detector, which detects a maximum value $\phi_{max}$ in the auto-correlation coefficient $\phi_i$ calculated by the auto-correlator 3 and outputs it and, at the same time, detects a delay time $\tau$ for providing the maximum value $\phi_{max}$ and outputs it as a possibility of the pitch.

Reference numerals 20 to 120 denote gate circuits, which select that one of outputs $\phi_{20}$ to $\phi_{120}$ from the auto-correlation 3 which should be applied to the maximum value detector 4. Accordingly, it will be understood that by controlling the gate circuits 20 to 120, the pitch searching period can freely be shifted and that setting of the pitch searching periods of modes 0 to 8 shown in FIG. 1 and the mode transition can easily be achieved.

Figure 4:
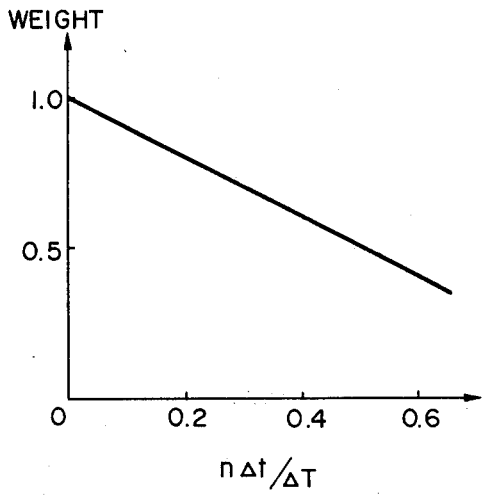
FIG. 4 is a diagram explanatory of weighting of an autocorrelation coefficient by an auto-correlation method used in this invention.

Reference numeral 5 represents a weighting selector for weighting the output from the maximum value detector 4. That is, the auto-correlation coefficient $\phi_i$ obtained by the aforesaid equation (1) is weighted as shown in FIG. 4, since the number of terms of the sum of products decreases with an increase in the number i, as is evident from the equation (1). Then, in a case of make various decisions using the auto-correlation coefficient, it is necessary to perform a modification using the following equation:

$$\phi_i' = \phi_i \cdot \omega_i \qquad (3)$$

It is the weighting selector 5 that selects $\omega_i$ in the equation (3) on the basis of the pitch $\tau$ outputted from the maximum value detector 4, and it is a multiplier 201 that performs weighting.

Reference numeral 15 shows a threshold circuit which has a threshold value $V_{15}$ (0.5 in the present embodiment) and decides that a voice input is a voiced sound wave when the value $\phi'_{max}$ exceeds the threshold value $V_{15}$.

Reference numeral 203 refers to an OR gate circuit which obtains the logical sum of the outputs from the threshold circuits 12, 13 and 14. In the present embodiment, in a case of satisfying any one of the conditions that $\phi'_{max}$ is larger than 0.5, that the input energy E is larger than the threshold value $V_{14}$ or that the rate $\delta$ of the residual energy is less than 0.25, the OR gate circuit 203 provides at its output a logical level "1", from which it can be decided that the voice input is a voiced sound wave. In a case of the voiced sound wave being decided, a multiplier 202 (which may also be a mere gate circuit) is actuated by the output from the OR gate circuit 203, and the delay time $\tau$ detected by the maximum value detector 4 is regarded as the pitch cycle and outputted at an output terminal 300. At the same time, a counter 7 hereinafter called as a pause counter is reset.

The pause counter 7 is to count the time length of the voice input which is decided as not a voiced sound wave, and adds the logical level "1" derived from a NOT circuit 11 receiving the output from the OR gate circuit 203, at intervals of 20 ms for detecting the pitch.

A threshold circuit 16 is provided to decide the contents of the pause counter 7 and resets a mode buffer 10 when the contents of the pause counter 7 becomes "6", that is, 120 ms.

The mode buffer 10 is a matrix circuit which controls the gate circuits 20 to 120 and a switching circuit 121 in accordance with the condition of an input signal to set to the modes 0 to 8, and when reset, sets to the mode 0.

The switching circuit 121 is to apply the value $\phi'_{max}$ to a threshold circuit 19 in a case of the mode 0 and the value $\phi'_{max}$ to threshold circuits 17 and 18 in cases of the modes 0 to 80 by means of the mode buffer 10 as described above, thereby performing processings of the mode 0 and the modes 1 to 8 separately to each other. That is, even when the mode suitable for use at the next pitch sampling point of time is selected on the basis of the pitch detected in the mode 0, if the pitch thus detected is that of a nasal sound or nasalized vowel, detecting of the pitch is not so accurate as described previously, so that the pitch cannot be regarded as correct. It is necessary to continue detection of the pitch in the mode 0 until the pitch is correctly detected from other voiced sounds. In the modes 1 to 8, it is necessary that when an incorrect pitch is detected, the operation be returned to the mode 0.

The above processing concerning the mode 0 is achieved by the threshold circuit 19 having a threshold value $V_{19}$, a mode selector 9, a gate circuit 123 and a NOT gate circuit 124. As described previously, in the mode 0, it is necessary to select the mode suitable for the next pitch detection at the time when the auto-correlation of the voice input is high and stable. Accordingly, in the present embodiment, the threshold value $V_{19}$ of the threshold circuit 19 is set at a high value of 0.9. The mode selector 9 is started by the logical level "1" derived from the threshold circuit 19 and identifies, on the basis of the output signal from a multiplier 202, that is, the pitch detected at the present pitch detecting point of time, the mode which includes the pitch in the stable region, and further outputs a voltage or a code corresponding to the identified mode. The gate circuit 123 is gated by the output signal from the threshold circuit 19 to apply to the NOT gate circuit 124 the output signal from the mode selector 9 as it is. When the output signal from the threshold circuit 13 has the logical level "1", that is, when the voice input is a nasal sound wave or a nasalized vowel wave, the NOT gate circuit 124 is closed to hold the mode 0 without updating the mode buffer 10; and when the output signal from the threshold circuit 13 has the logical level "0", that is, when the voice input is a voiced sound wave except a nasal sound wave or a nasalized vowel wave, the output signal from the gate circuit 123 is regarded as suitable for use at the next pitch detecting point of time and the mode buffer 10 is updated.

Processing relating to the modes 1 to 8 is carried by threshold circuits 17 and 18, a mode selector 8, a gate circuit 122 and an AND circuit 204. The threshold circuit 17 outputs the logical level "1" when the auto-correlation of the voice input is low (in the present embodiment, the value of $\phi'_{max}$ is smaller than 0.4). The AND circuit 204 obtains the logical sum of the output signal A of the threshold circuit 12 and the output signal of the threshold circuit 17 to decide that the auto-correlation has become low while the voice input is a voiced sound wave, and regarding this as indicating the possibility of pitch detection using an incorrect mode, resets the mode buffer 10 to set to the mode 0. The mode selector 8, identifies the mode suitable for use at the next pitch detection point of time on the basis of the output signal from the multiplier 202 by the same operation as the mode selector 9 when the condition where the value $\phi'_{max}$ is decided by the threshold circuit 18 to be larger than 0.8, that is, the pitch can be stably detected is satisfied and outputs the corresponding voltage or a code to update the mode buffer 10 via the gate circuit 122, adaptively setting the modes 1 to 8.

The foregoing has described one embodiment of the invention. The constants mentioned therein correspond to those in a case where the pitch is detected for each 20 msec and the input voice signal is sampled at a sampling frequency of 8 kHz after passing through a 500 Hz low-pass filter. In general, the constants must be modified in accordance with the input condition, the sampling frequency and the pitch sampling period, and the system of this invention accurately operates under various conditions by constants into which those in the present embodiment are suitably converted.

Accordingly, the use of the system of this invention permits accurate detection of the pitch in the part of a glide and the ending of a word and a nasal sound in a continuous voice wave in which the prior art encounters difficulty; hence, the pitch can stably be detected in a continued voice wave.

As has been described in the foregoing, in accordance with this invention using real time processing, the pitch of a voice signal can be sampled more accurately than the prior art. Accordingly, by applying this invention to a vocoder or a like system for coding and transmitting a voice signal with high efficiency, a voice signal of high quality can be obtained.

What we claim is:

1. An adaptive pitch detection system for detecting the pitch of a voice signal, comprising:

input terminal means for receiving the voice signal;

detection means connected to the input terminal means for detecting the pitch from one of a plurality of predetermined pitch searching periods, which are determined so that pitch components of multiple relationships are not included in each of the pitch searching periods; and control means connected to said detection means for adaptively shifting said one of the predetermined pitch searching periods so as to follow the change direction of the pitch predicted from the result of detection of the detected pitch.

2. An adaptive pitch detection system according to claim 1, in which said control means comprises means for shifting said one of the predetermined pitch searching periods in accordance with predetermined order before said pitch is detected from said one of predetermined pitch searching periods.

3. An adaptive pitch detection system according to claim 1, in which said control means comprises means for shifting said one of the predetermined pitch searching periods to the vicinity of said one of the predetermined pitch searching periods immediately after said pitch is not detected from said one of predetermined pitch searching periods.

4. An adaptive pitch detection system according to claim 3, in which said control means further comprises means for shifting said one of the predetermined pitch searching periods to an initial pitch searching period predetermined from said predetermined pitch searching periods when said pitch is not detected in the vicinity.

* * * * *